US006769415B2

(12) United States Patent
Reddy et al.

(10) Patent No.: US 6,769,415 B2
(45) Date of Patent: Aug. 3, 2004

(54) EVAPORATIVE CONTROL SYSTEM

(75) Inventors: Sam Raghuma Reddy, West Bloomfield, MI (US); R. Vance Mc Cabe, Jr., Fenton, MI (US)

(73) Assignee: General Motors Corporation, Detroit, MI (US)

( * ) Notice: Subject to any disclaimer, the term of this patent is extended or adjusted under 35 U.S.C. 154(b) by 72 days.

(21) Appl. No.: 10/151,430

(22) Filed: May 20, 2002

(65) Prior Publication Data

US 2002/0174857 A1 Nov. 28, 2002

Related U.S. Application Data

(60) Provisional application No. 60/293,475, filed on May 25, 2001.

(51) Int. Cl.[7] ..... F02M 33/02
(52) U.S. Cl. ..... 123/519; 123/520
(58) Field of Search ..... 123/516, 518, 123/519, 520, 549, 557

(56) References Cited

U.S. PATENT DOCUMENTS 4,708,777 A 11/1987 Kuraoka ..... 204/1 T
5,408,976 A * 4/1995 Reddy ..... 123/519
5,456,236 A * 10/1995 Wakashiro et al. ..... 123/519
5,456,237 A * 10/1995 Yamazaki et al. ..... 123/520
5,495,912 A * 3/1996 Gray et al. ..... 180/165
5,560,347 A 10/1996 Reddy et al. ..... 123/520
5,902,224 A 5/1999 Bloom ..... 494/25
6,098,601 A * 8/2000 Reddy ..... 123/520
6,279,548 B1 8/2001 Reddy ..... 123/520
6,354,280 B1 * 3/2002 Itakura et al. ..... 123/519
6,540,815 B1 * 4/2003 Hiltzik et al. ..... 95/146

* cited by examiner

*Primary Examiner*—Mahmoud Gimie
(74) *Attorney, Agent, or Firm*—Kathryn A. Marra

(57) ABSTRACT

An evaporative control system for conventional or hybrid vehicles includes a fuel tank for storing a volatile fuel and an engine having an air induction system. A primary canister contains a first volume of a first adsorbent material, a vapor inlet coupled to the fuel tank, a purge outlet coupled to the air induction system, and a vent/air inlet. A secondary canister is coupled to the vent/air inlet and contains a second volume of a second adsorbent material that is different than the first adsorbent material. The first and second adsorbent materials adsorb fuel vapors when the engine is not running to reduce breakthrough and desorb fuel vapors when the engine is running. The second adsorbent material adsorbs butanes and pentanes at low concentrations. The second adsorbent material includes activated carbon derived from a coconut shell and a heater.

36 Claims, 7 Drawing Sheets

EVAPORATIVE CONTROL SYSTEM

CROSS-REFERENCE TO RELATED APPLICATIONS

This application claims the benefit of U.S. Provisional Application No. 60/293,475, filed May 25, 2001, which is hereby incorporated by reference.

FIELD OF THE INVENTION

The present invention relates to evaporative control systems for hybrid and non-hybrid vehicles, and more specifically to an evaporative canister system that reduces breakthrough.

BACKGROUND OF THE INVENTION

Gasoline typically includes a mixture of hydrocarbons ranging from high volatility butane (C-4) to lower volatility C-8 to C-10 hydrocarbons. When vapor pressure increases in the fuel tank due to conditions such as ambient temperature, fuel vapor flows through openings in the fuel tank. To prevent fuel vapor loss into the atmosphere, the fuel tank is vented into a canister that contains an absorbent material such as activated carbon granules.

As the fuel vapor enters an inlet of the canister, the fuel vapor diffuses into the carbon granules and is temporarily adsorbed. The size of the canister and the volume of the adsorbent material are selected to accommodate the expected fuel vapor evaporation. After the engine is started, the control system uses engine intake vacuum to draw air through the adsorbent to desorb the fuel. The desorbed fuel vapor is directed into an air induction system of the engine as a secondary air/fuel mixture. One exemplary evaporative control system is described in U.S. Pat. No. 6,279,548 to Reddy, which is hereby incorporated by reference.

When the vehicle remains idle, fuel vapor accumulates in the canister. The initial loading is at the inlet end of the canister. Over time, the fuel vapor is gradually distributed along the entire bed of the adsorbent material. After the engine is started, a purge valve is opened and air is drawn through the canister. The air removes the fuel vapor that is stored in the adsorbent material.

SUMMARY OF THE INVENTION

An evaporative control system according to the present invention for a vehicle includes a fuel tank for storing a volatile fuel and an engine having an air induction system. A primary canister contains a first volume of a first adsorbent material, a vapor inlet coupled to the fuel tank, a purge outlet coupled to the air induction system, and a vent/air inlet. A secondary canister is coupled to the vent/air inlet and contains a second volume of a second adsorbent material that is different than the first adsorbent material. The first and second adsorbent materials adsorb fuel vapors when the engine is not running to reduce breakthrough and desorb fuel vapors when the engine is running.

In still other features, the second adsorbent material may include activated carbon derived from a coconut shell. The first adsorbent material may include activated carbon derived from wood. In certain embodiments, the evaporative control system may reduce breakthrough below 4 mg/day.

In yet other features, the secondary canister includes a housing and a heater that heats the secondary volume of the second adsorbent material. Alternately, the secondary canister includes a housing, a heater located outside of the housing and a heat sink. The heater heats the heat sink. The heat sink heats the secondary volume of the second adsorbent material. The heat sink includes a plurality of plates that are coated with the second adsorbent material.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
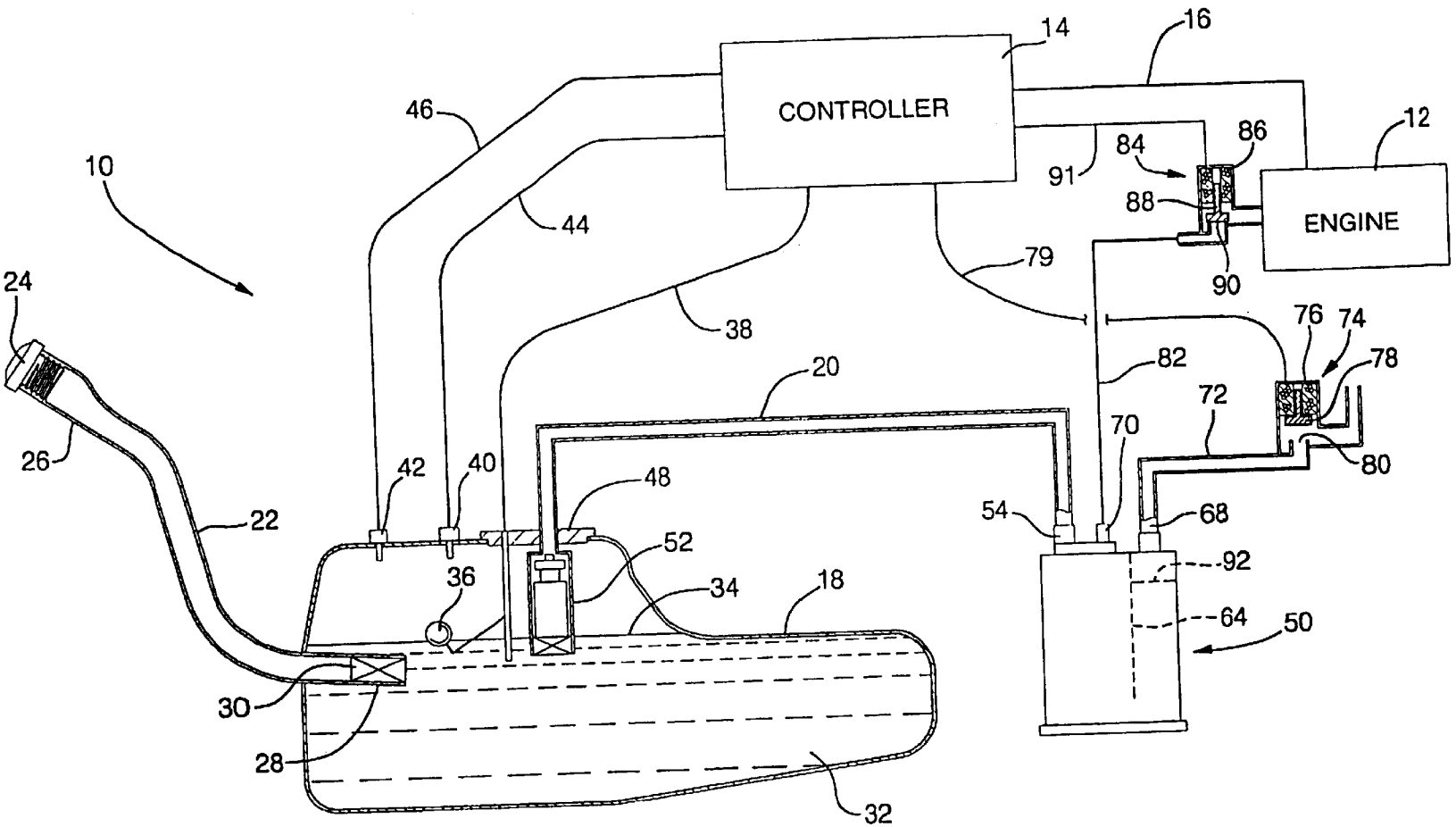
FIG. 1 is a functional block diagram of an evaporative control system for a vehicle.
Figure 2:
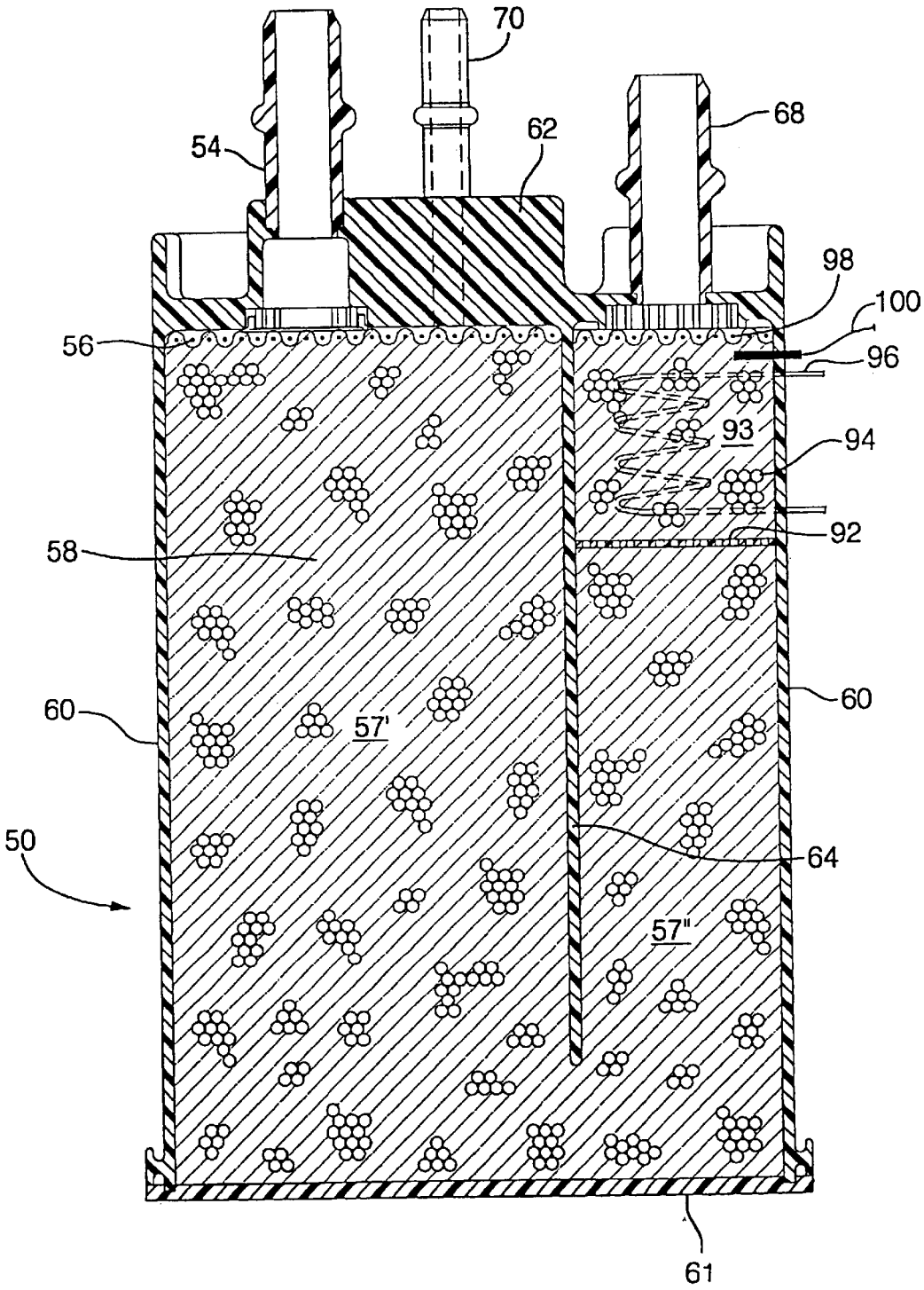
FIG. 2 is a cross sectional view of a primary canister with a primary volume including a first adsorbent material and a secondary volume including a secondary adsorbent material according to the present invention.

Referring now to FIGS. 1 and 2, an evaporative control system 10 for a vehicle including an engine 12 is illustrated. The vehicle may be a conventional (non-hybrid) or a hybrid vehicle including an internal combustion engine and an electric motor (not shown). The engine 12 is preferably an internal combustion engine that is controlled by a controller 14. The engine 12 typically burns gasoline, ethanol and other volatile hydrocarbon-based fuels. The controller 14 may be a separate controller or may form part of an engine control module (ECM), a powertrain control module (PCM) or any other vehicle controller.

When the engine 12 is started, the controller 14 receives signals from one or more engine sensors, transmission control devices, and/or emissions control devices. Line 16 from the engine 12 to the controller 14 schematically depicts the flow of sensor signals. During engine operation, gasoline is delivered from a fuel tank 18 by a fuel pump (not shown) through a fuel line (not shown) to a fuel rail. Fuel injectors inject gasoline into cylinders of the engine 12 or to ports that supply groups of cylinders. The timing and operation of the fuel injectors and the amount of fuel injected are managed by the controller 14.

The fuel tank 18 is typically a closed container except for a vent line 20. The fuel tank 18 is often made of blow molded, high density polyethylene provided with one or more gasoline impermeable interior layer(s). The fuel tank 18 is connected to a fill tube 22. A gas cap 24 closes a gas fill end 26 of the fill tube 22. The outlet end 28 of the fill tube 22 is located inside of the fuel tank 18. A one-way valve 30 prevents gasoline from splashing out of the fill tube 22. An upper surface of the gasoline is identified at 34. A float-type fuel level indicator 36 provides a fuel level signal at 38 to the controller 14. A pressure sensor 40 and a temperature sensor 42 optionally provide pressure and temperature signals 44 and 46 to the controller 14.

The fuel tank 18 includes a vent line 20 that extends from a seal 48 on the fuel tank 18 to a primary canister 50. A float valve 52 within the fuel tank 18 prevents liquid gasoline from entering the vapor vent line 20. Fuel vapor pressure increases as the temperature of the gasoline increases. Vapor flows under pressure through the vent line 20 to the vapor inlet of the primary canister 50. The vapor enters canister vapor inlet 54, flows past a retainer element 56 and diffuses into a primary volume 57' and 57" of a first adsorbent material 58.

The primary canister 50 is formed of any suitable material. For example, molded thermoplastic polymers such as nylon are typically used. The primary canister 50 includes side walls 60, a bottom 61, and a top 62 that define an internal volume. A vertical internal wall 64 extends downwardly from the top 62. A vent opening 68 at the top 62 serves as an inlet for the flow of air during purging of adsorbed fuel vapor from the first adsorbent material 58. A purge outlet 70 is also formed in the top 62. A stream of purge air and fuel vapor exit the canister through the purge outlet 70.

A vent line 72 and solenoid actuated vent valve 74 are connected to the vent opening 68. The vent valve 74 is normally open as shown. A solenoid 76 moves a stopper 78 to cover the vent opening 80. The solenoid 76 is actuated by the controller 14 through a signal lead 79. The vent valve 74 is usually closed for diagnostic purposes only.

The purge outlet 70 is connected by a purge line 82 through a solenoid actuated purge valve 84 to the engine 12. The purge valve 84 includes a solenoid 86 and a stopper 88 that selectively close an opening 90. Purge valve 84 is operated by the controller 14 through a signal lead 91 when the engine 12 is running and can accommodate a secondary air/fuel mixture.

Referring now to FIGS. 1 and 2, as an air/fuel mixture flows from the fuel tank 18 through the vent line 20 and the inlet 54 into the primary canister 50, fuel vapor is absorbed by the first adsorbent material 58 in the primary canister 50. Gradually, the first adsorbent material 58 becomes laden with butane and heavier hydrocarbons. The vapor settles into the first adsorbent material 58 on the left side volume 57' of the wall 64. A flow path exists from the first absorbent material 58 on the left side volume 57' of the wall 64 to the first absorbent material 58 on the right side volume 57".

When the vent valve 74 is open, the vapor passes through the first adsorbent material 58 to the right of the wall 64. The vapors pass through a porous, thermal insulator separator 92 into a secondary volume 93 including a second adsorbent material 94. An electrical heating element 96 is embedded in the secondary volume 93 of the second adsorbent material 94. The secondary volume 93 of the second adsorbent material 94 is located between the porous separator 92 and a retainer element 98. When the primary volume 57' and 57" of the first adsorbent material 58 and the secondary volume 93 of the second absorbent material 94 become saturated with vapor, vapor and air exit the primary canister 50 at the vent opening 68. The vapor and air pass through the vent line 72 and the open vent valve 74.

When the engine is operating, the controller 14 opens the purge valve 84 to allow air to be drawn past the vent valve 74. The air flows through the vent line 72 and into the vent opening inlet 68. The air is drawn through the extended path. In other words, air flows through the secondary volume 93 and the primary volume 57' and 57". The air becomes laden with desorbed fuel vapor and exits the purge outlet 70. The fuel-laden air is drawn through the purge line 82 and the purge valve 84 into the engine 12.

The temperature of the first adsorbent material 58 is roughly equal to the ambient temperature of the engine compartment. The temperature of the first absorbent material 58 may be raised by heat of adsorption or desorption of the fuel vapor. Before the purge valve 84 is opened, the controller 14 actuates the heating element 96 to heat the secondary volume 93. The temperature of the secondary volume 93 is preferably controlled by the controller 14 using a temperature sensor 100.

The first adsorbent material 58 is preferably activated carbon granules. One suitable activated carbon is wood based activated carbon. For example, Westvaco wood carbon 15 BWC is typically used. Other activated carbon granules that are currently used in conventional canisters are also contemplated. The breakthrough (or bleed emissions) from the secondary volume primarily consist of butane and pentanes at very low concentrations. The present invention utilizes the second adsorbent to adsorb these light hydrocarbons at very low concentrations. The activated carbon that is typically used in current production canisters is not suitable for use in the secondary volume.

The second absorbent material is preferably activated carbon derived from coconut shells. Activated carbon that is derived from a coconut shell was identified by observing the adsorption isotherms, pore sizes, and pore volumes of various activated carbons. Coconut shell activated carbon contains a high percentage of micropores (0–20 Angstroms), which are suitable for adsorbing low concentrations of butanes and pentanes. Typical low concentrations are between 0.1 and 0.5 percent.

Figure 3:
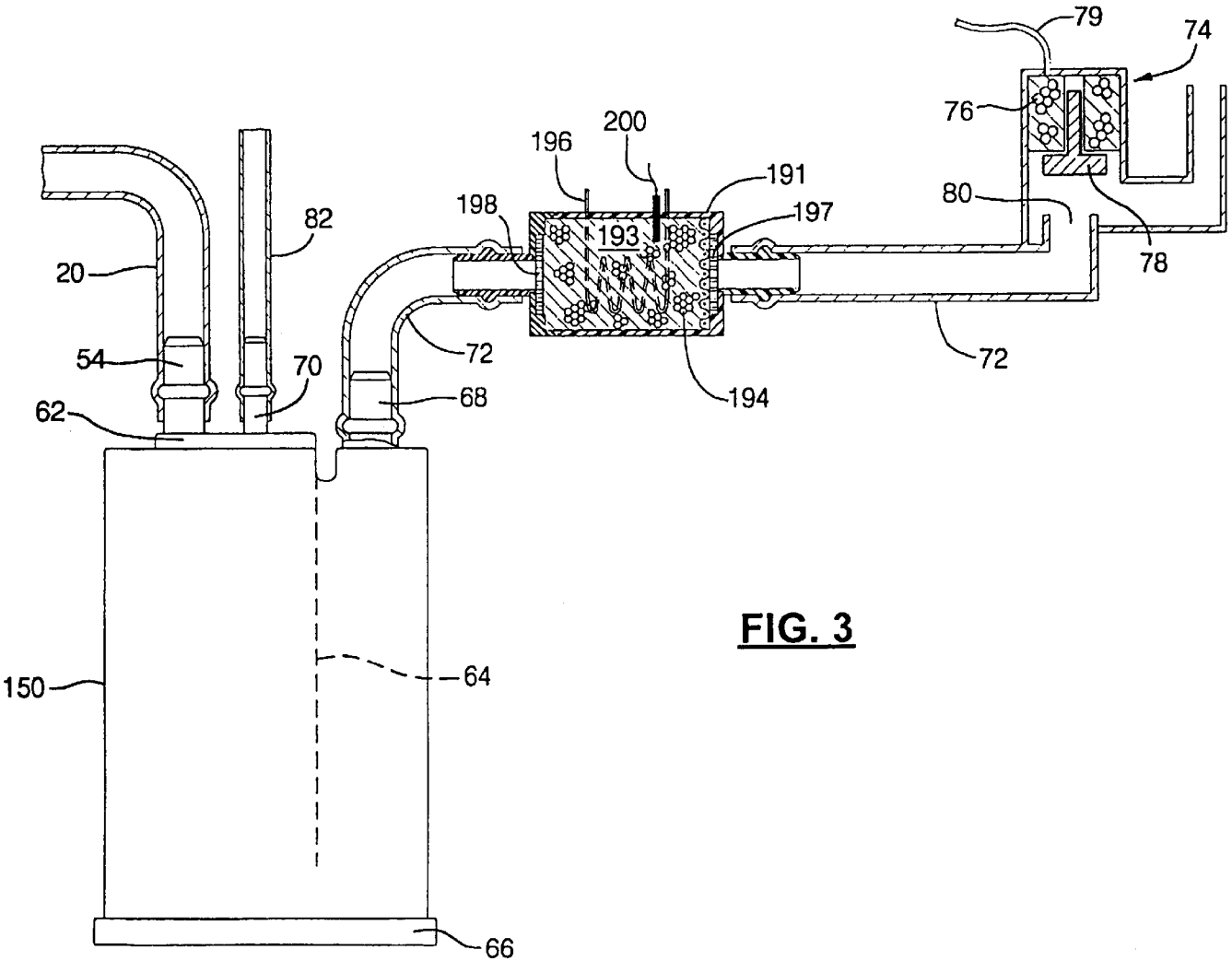
FIG. 3 is a cross sectional view of a secondary canister that can be added to a conventional primary canister according to the present invention.

Referring now to FIG. 3, the present invention may include a separate secondary canister that is added to a conventional primary canister. The secondary volume 193 of the second adsorbent material 194 is located in the secondary canister 191. The secondary canister 191 is located in the vent line 72 between the conventional primary canister 150 and the vent valve 74. The primary canister 150 is similar to the primary canister 50 depicted in FIG. 2 except that the secondary volume 93 of the second adsorbent material 94 is omitted.

The secondary canister 191 includes the secondary volume 193 of the second adsorbent material 194 and a heating element 196. The heating element 196 is controlled by the controller 14. The heating element 196 is preferably turned on prior to opening of the purge valve 84. The second absorbent material 194 is retained by porous retainers 197 and 198.

Air and light hydrocarbons that escape from the primary canister 150 enters the secondary canister 191 where they are temporarily adsorbed. After engine startup, the heating element 196 is activated and the second adsorbent material 194 is heated. A temperature sensor 200 is used to control the heating element 196. After the purge valve 84 (FIG. 1) is opened, air flows through the vent valve 74, the secondary volume 193, and the primary canister 150 to fully remove the adsorbed fuel vapor.

The secondary canister contains about 25 cc of coconut carbon, for example Barnebey Sutcliffe coconut shell carbon 208C. The secondary canister was heated by the heating element 196 to about 150° C. The heating in the secondary canister helps with the purging of the secondary canister. If a heated purge is required for the primary canister, power can also be supplied to the heating element 196 of the secondary canister 191.

Figure 4:
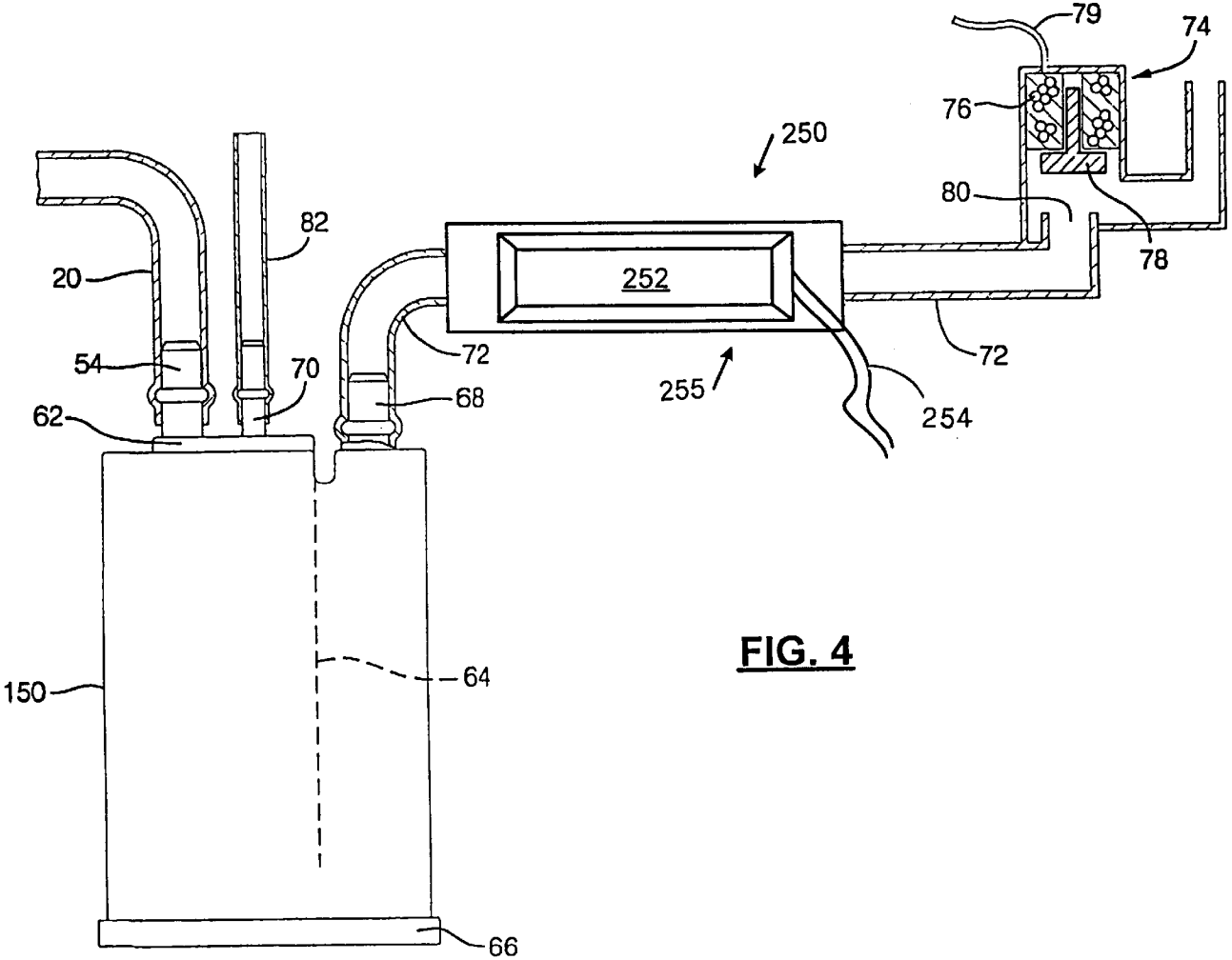
FIG. 4 is a cross sectional view of an alternate secondary canister that can be added to a conventional primary canister according to the present invention.
Figure 5:
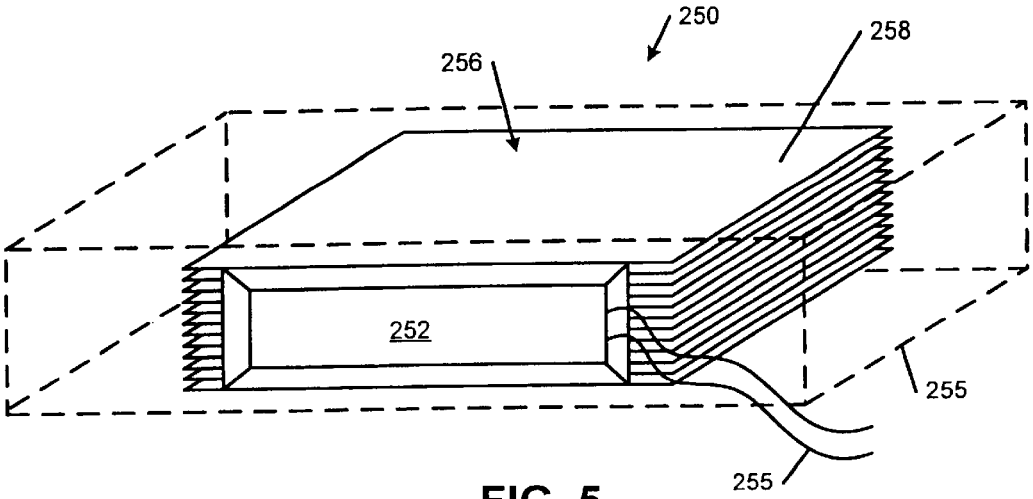
FIG. 5 is a more detailed perspective view of the alternate secondary canister of FIG. 4.

Referring now to FIGS. 4 and 5, an alternate secondary canister 250 is shown. The secondary canister 250 includes a heater element 252 that is connected by leads 254 to a power source (not shown). Preferably, the heater element 252 is located outside of a housing 255 of the second canister 250. A heat sink 256 is connected to the heater element 252. Preferably, the heat sink 256 includes a plurality of spaced plates 258. The plates 258 are coated with the second absorbent material. The heater element 252 heats the plates 258 of the heat sink 256. Air flowing between the plates 258 adsorb and desorb vapors. As can be appreciated, positioning the heater outside of the secondary canister improves the energy efficiency and operational safety of the canister system.

Figure 6:
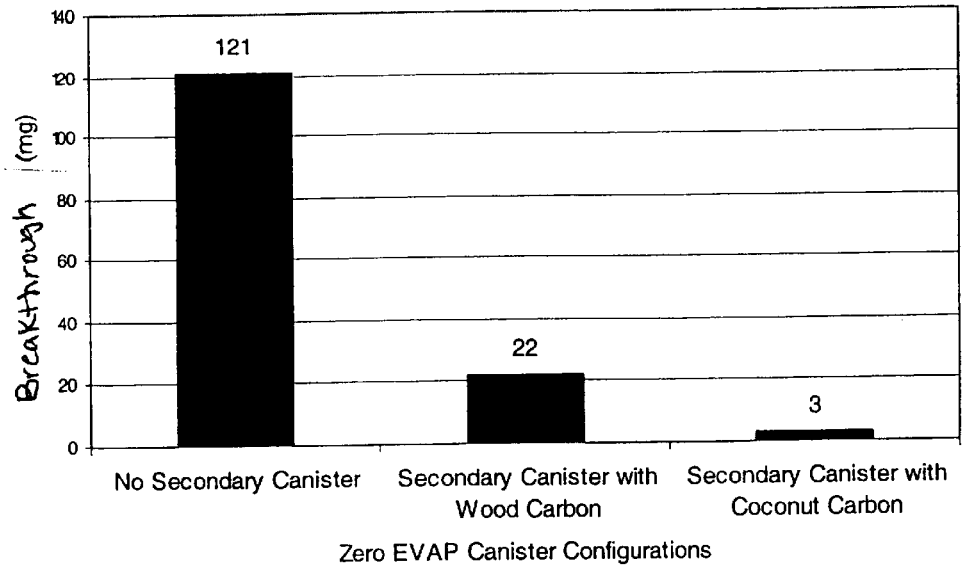
FIG. 6 is a bar chart illustrating breakthrough performance of certain exemplary evaporative control systems.

Referring now to FIG. 6, the canisters according to the present invention advantageously can reduce breakthrough. Tests were conducted to determine the effectiveness of heated coconut carbon secondary canister in reducing breakthrough in a CARB three-day diurnal emissions test. A conventional canister may have about 121 mg/day breakthrough. A heated wood carbon secondary canister may have about 22 mg/day breakthrough. In certain embodiments and conditions, the canisters according to the present invention may have 3 mg/day breakthrough. A non-heated coconut carbon canister or a primary canister including coconut carbon as the adsorbent material will operate poorly. Coconut carbon has poor ambient temperature purge characteristics. In other words, the coconut carbon absorbs vapors efficiently at ambient temperatures. However, coconut carbon desorbs vapors slowly at ambient temperatures.

Figure 7:
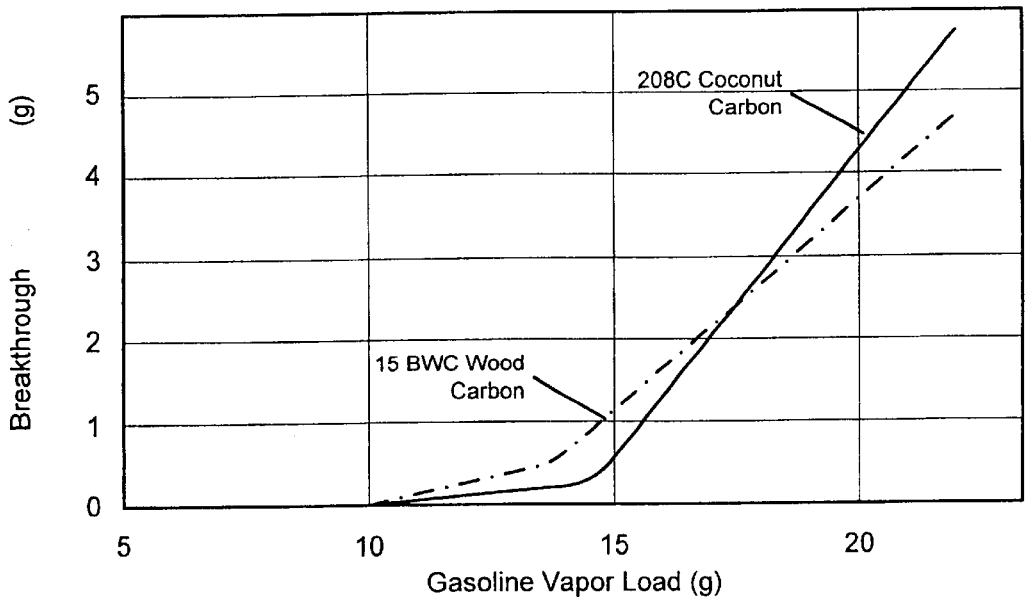
FIG. 7 is a graph illustrating breakthrough as a function of gasoline vapor load.
Figure 8:
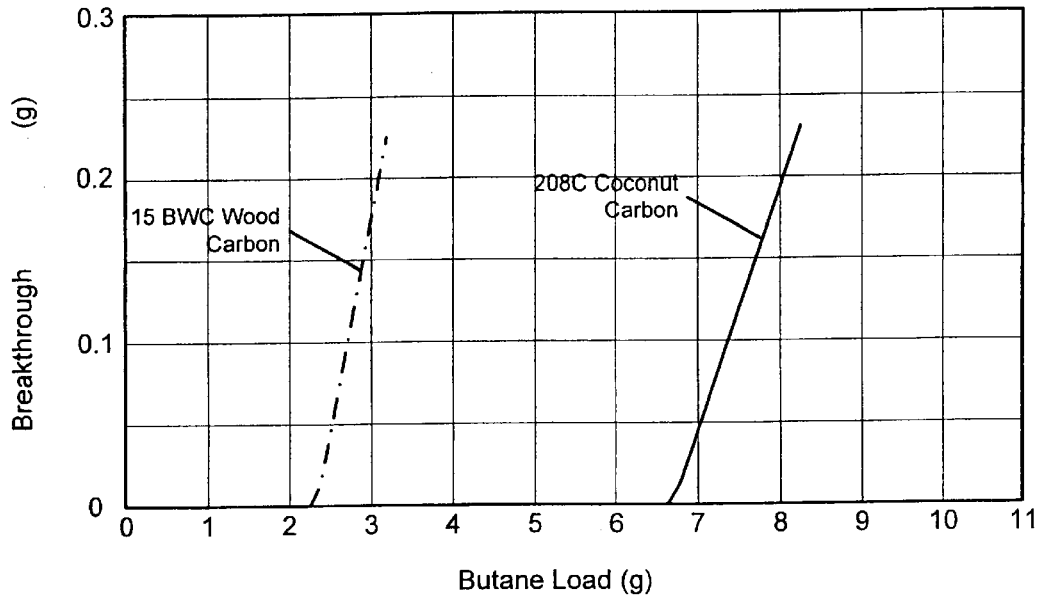
FIG. 8 is a graph illustrating breakthrough as a function of butane load.

Referring now to FIG. 7, breakthrough is shown as a function of gasoline vapor load. As can be appreciated from FIG. 7, the adsorption capacity of the coconut carbon adsorbent material is nearly the same as the adsorption capacity for wood carbon (such as Westvaco wood carbon 15 BWC). The load vapor is RPV7@75F gasoline vapor (30% HC in air). Referring now to FIG. 8, the adsorption capacity of the coconut carbon adsorbent material is significantly higher for very low concentrations of light hydrocarbons. The load vapor in FIG. 8 is 0.5% butane (C4) in air. Therefore, both carbons (wood and coconut) store nearly the same amount of gasoline vapor. However, coconut carbon is more effective in adsorbing low concentrations of butanes and pentanes, which reduces breakthrough. The high capacity of coconut carbon for adsorbing butanes and pentanes at low concentrations results in a small volume of adsorbent in the secondary canister.

Figure 9:
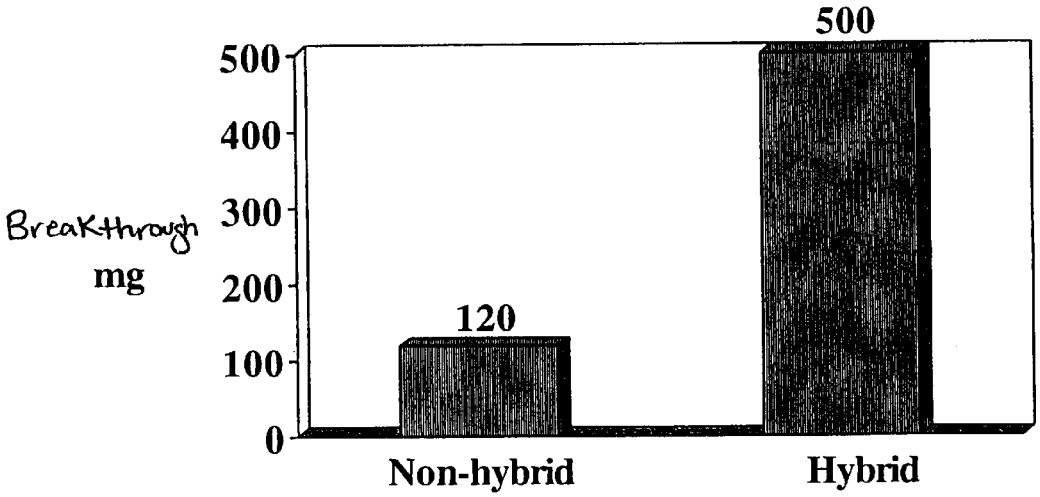
FIG. 9 is a bar chart illustrating evaporative breakthrough of hybrid and non-hybrid vehicles.

Evaporative fuel vapor is stored in an activated carbon canister. The evaporative fuel vapor is purged and consumed in the engine during combustion. If the canister is not purged with a sufficient volume of purge air, as in the case of hybrid vehicles, the canister breakthrough will increase as is illustrated in FIG. 9. The non-hybrid canister breakthrough should preferably be reduced to near zero to meet zero evaporation standards. Hybrid vehicle breakthrough may be reduced to near zero by using a secondary canister with coconut carbon or a primary canister with a secondary chamber with coconut carbon as described above with respect to FIGS. 2–5.

Preferably, the secondary canister or secondary chamber have between 15 and 50 cc volume that contains coconut carbon and a heater. The heater is used to increase the coconut carbon temperature to about 110° C. prior to purging with ambient air. Heating the carbon to 110° C. and purging with air may result in complete removal of all adsorbed hydrocarbons (including heel hydrocarbons), which results in zero breakthrough. Furthermore, a heated coconut carbon canister reduces the breakthrough of a hybrid vehicle to near-zero to meet zero evaporation standards—down to about 3 mg/day breakthrough. The volume of coconut carbon in the secondary chamber or canister is preferably about 25 cc, which will require about 25 watt.min of energy for required heating.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An evaporative emissions control system for a vehicle, comprising:

a fuel tank for storing a volatile fuel;

an engine having an air induction system;

a primary canister containing a first volume of a first adsorbent material, a vapor inlet coupled to said fuel tank, a purge outlet coupled to said air induction system, and a vent/air inlet; and a secondary canister coupled to said vent/air inlet and containing a second volume of a second adsorbent material that is different than said first adsorbent material, wherein said first and second adsorbent materials adsorb fuel vapors when said engine is not running to reduce bleed emissions and desorb fuel vapors when said engine is running; and wherein said second adsorbent material adsorbs butanes and pentanes at low concentrations.

2. The evaporative emissions system of claim 1 wherein said evaporative emissions system reduces bleed emissions below 4 mg/day.

3. The evaporative emissions system of claim 1 wherein said engine is integrated with a hybrid powertrain.

4. An evaporative emissions control system for a vehicle, comprising:

a fuel tank for storing a volatile fuel;

an engine having an air induction system;

a primary canister containing a first volume of a first adsorbent material, a vapor inlet coupled to said fuel tank, a purge outlet coupled to said air induction system, and a vent/air inlet; and a secondary canister coupled to said vent/air inlet and containing a second volume of a second adsorbent material that is different than said first adsorbent material, wherein said first and second adsorbent materials adsorb fuel vapors when said engine is not running to reduce bleed emissions and desorb fuel vapors when said engine is running; and wherein said second adsorbent material includes activated carbon derived from a coconut shell.

5. The evaporative emissions system of claim 4 wherein said secondary canister includes a housing, a heater located outside of said housing and a heat sink located inside of said housing, wherein said heater heats said heat sink and said heat sink heats said secondary volume of said second adsorbent material.

6. The evaporative emissions system of claim 5 wherein said heat sink includes a plurality of spaced plates that are coated with said second adsorbent material.

7. An evaporative emissions control system for a vehicle, comprising:

a fuel tank for storing a volatile fuel;

an engine having an air induction system;

a primary canister containing a first volume of a first adsorbent material, a vapor inlet coupled to said fuel tank, a purge outlet coupled to said air induction system, and a vent/air inlet; and a secondary canister coupled to said vent/air inlet and containing a second volume of a second adsorbent material that is different than said first adsorbent material, wherein said first and second adsorbent materials adsorb fuel vapors when said engine is not running to reduce bleed emissions and desorb fuel vapors when said engine is running; and wherein said secondary canister includes a housing and a heater that heats said secondary volume of said second adsorbent material.

8. An evaporative emissions control system for a vehicle, comprising:

a fuel tank for storing a volatile fuel;

an engine having an air induction system;

a primary canister containing a first volume of a first adsorbent material, a vapor inlet coupled to said fuel tank, a purge outlet coupled to said air induction system, and a vent/air inlet; and a secondary canister coupled to said vent/air inlet and containing a second volume of a second adsorbent material that is different than said first adsorbent material, wherein said first and second adsorbent materials adsorb fuel vapors when said engine is not running to reduce bleed emissions and desorb fuel vapors when said engine is running; and wherein said first adsorbent material includes activated carbon derived from wood.

9. An evaporative emissions control system for a vehicle, comprising:

a fuel tank for storing a volatile fuel;

an engine having an air induction system; and a primary canister containing a first volume of a first adsorbent material, a vapor inlet coupled to said fuel tank, a purge outlet coupled to said air induction system, a vent/air inlet, and a second volume of a second adsorbent material that is different than said first adsorbent material and that is located between said first volume and said vent/air inlet, wherein said first and second adsorbent materials adsorb fuel vapors when said engine is not running to reduce bleed emissions and desorb fuel vapors when said engine is running; and wherein said second adsorbent material adsorbs butanes and pentanes at low concentrations.

10. The evaporative emissions system of claim 9 wherein said second volume is heated by a heater.

11. The evaporative emissions system of claim 9 wherein said evaporative emissions system reduces bleed emissions below 4 mg/day.

12. An evaporative emissions control system for a vehicle, comprising:

a fuel tank for storing a volatile fuel;

an engine having an air induction system; and a primary canister containing a first volume of a first adsorbent material, a vapor inlet coupled to said fuel tank, a purge outlet coupled to said air induction system, a vent/air inlet, and a second volume of a second adsorbent material that is different than said first adsorbent material and that is located between said first volume and said vent/air inlet, wherein said first and second adsorbent materials adsorb fuel vapors when said engine is not running to reduce bleed emissions and desorb fuel vapors when said engine is running; and wherein said second adsorbent material includes activated carbon derived from a coconut shell.

13. The evaporative emissions system of claim 12 wherein said engine is integrated with a hybrid powertrain.

14. An evaporative emissions control system for a vehicle, comprising:

a fuel tank for storing a volatile fuel;

an engine having an air induction system;

a primary canister containing a first volume of a first adsorbent material, a vapor inlet coupled to said fuel tank, a purge outlet coupled to said air induction system, a vent/air inlet, and a second volume of a second adsorbent material that is different than said first adsorbent material and that is located between said first volume and said vent/air inlet; and a heater located outside of said second volume and a heat sink located inside of said second volume, wherein said heater heats said heat sink and said heat sink heats said secondary volume of said second adsorbent material, wherein said first and second adsorbent materials adsorb fuel vapors when said engine is not running to reduce bleed emissions and desorb fuel vapors when said engine is running.

15. The evaporative emissions system of claim 14 wherein said heat sink includes a plurality of spaced plates that are coated with said second adsorbent material.

16. A method for reducing bleed emissions from an evaporative emissions control system for a vehicle, comprising:

storing a volatile fuel in a fuel tank;

providing a primary canister containing a first volume of a first adsorbent material;

coupling a vapor inlet of said primary canister to said fuel tank;

coupling a purge outlet of said primary canister to an air induction system of an engine of said vehicle;

coupling a secondary canister containing a second volume of a second adsorbent material to said vent/air inlet, wherein said second adsorbent material is different than said first adsorbent material;

adsorbing fuel vapors when said engine is not running using said first and second adsorbent materials;

desorbing fuel vapors from said first and second adsorbent materials when said engine is running; and adsorbing butanes and pentanes at low concentrations using said second adsorbent material.

17. The method of claim 16 further comprising heating said secondary volume of said second adsorbent material.

18. The method of claim 16 wherein said evaporative emissions system reduces bleed emissions below 4 mg/day.

19. A method for reducing bleed emissions from an evaporative emissions control system for a vehicle, comprising:

storing a volatile fuel in a fuel tank;

providing a primary canister containing a first volume of a first adsorbent material;

coupling a vapor inlet of said primary canister to said fuel tank;

coupling a purge outlet of said primary canister to an air induction system of an engine of said vehicle;

coupling a secondary canister containing a second volume of a second adsorbent material to said vent/air inlet, wherein said second adsorbent material is different than said first adsorbent material;

adsorbing fuel vapors when said engine is not running using said first and second adsorbent materials; and desorbing fuel vapors from said first and second adsorbent materials when said engine is running, wherein said second adsorbent material includes activated carbon derived from a coconut shell.

20. A method for reducing bleed emissions from an evaporative emissions control system for a vehicle, comprising:

storing a volatile fuel in a fuel tank;

providing a primary canister containing a first volume of a first adsorbent material;

coupling a vapor inlet of said primary canister to said fuel tank;

coupling a purge outlet of said primary canister to an air induction system of an engine of said vehicle;

coupling a secondary canister containing a second volume of a second adsorbent material to said vent/air inlet, wherein said second adsorbent material is different than said first adsorbent material;

adsorbing fuel vapors when said engine is not running using said first and second adsorbent materials;

desorbing fuel vapors from said first and second adsorbent materials when said engine is running; and locating a heater outside of said secondary volume and a heat sink inside of said secondary volume.

21. The method of claim 20 wherein said heat sink includes a plurality of spaced plates that are coated with said second adsorbent material.

22. A method of reducing breakthrough vapor escaping a fuel vapor storage and recovery system, comprising:

providing a chamber containing coconut carbon; and using said coconut carbon in said chamber to reduce low concentrations of at least one of butanes and pentanes.

23. The method of claim 22 wherein said low concentrations are approximately between 0.1 and 0.5 percent.

24. The method of claim 22 wherein said pentanes are isopentanes.

25. The method of claim 22 wherein said fuel vapor storage and recovery system includes a primary canister and a secondary canister, and wherein said secondary canister defines said chamber.

26. The method of claim 22 wherein said fuel vapor storage and recovery system includes a primary canister having primary and secondary volumes, and wherein said secondary volume of said primary canister defines said chamber.

27. The method of claim 22 wherein said chamber contains less than 20 cc of said coconut carbon.

28. The method of claim 22 further comprising heating said coconut carbon.

29. A fuel vapor storage and recovery system comprising:

a first chamber containing a first adsorbent that adsorbs fuel vapors and that purges said fuel vapors; and a second chamber in fluid communication with said first chamber that contains coconut carbon.

30. The fuel vapor storage and recovery system of claim 29 wherein said coconut carbon adsorbs low concentrations of at least one of butanes and pentanes.

31. The fuel vapor storage and recovery system of claim 30 wherein said low concentrations are approximately between 0.1 and 0.5 percent.

32. The fuel vapor storage and recovery system of claim 30 wherein said pentanes are isopentanes.

33. The fuel vapor storage and recovery system of claim 29 further comprising a heater that heats said coconut carbon.

34. The fuel vapor storage and recovery system of claim 33 wherein said coconut carbon is dispersed on surfaces heated by said heater.

35. The fuel vapor storage and recovery system of claim 29 wherein said fuel vapor storage and recovery system includes a primary canister defining said first chamber, and a secondary canister, and wherein said secondary canister defines said second chamber.

36. The fuel vapor storage and recovery system of claim 29 wherein said fuel vapor storage and recovery system includes a primary canister having primary and secondary volumes, and wherein said secondary volume of said primary canister defines said second chamber.

* * * * *